United States Patent [19]

Chumley et al.

[11] Patent Number: 4,881,656

[45] Date of Patent: Nov. 21, 1989

[54] TAMPER EVIDENT CONTAINER LID AND METHOD OF MAKING THE SAME

[75] Inventors: Dexter W. Chumley, Fremont, Ohio; Fredrick O. Miller, Saginaw, Mich.

[73] Assignee: Sandusky Plastics, Inc., Sandusky, Ohio

[21] Appl. No.: 261,508

[22] Filed: Oct. 24, 1988

[51] Int. Cl.[4] ..... B65D 17/40; B65D 41/48

[52] U.S. Cl. ..... 220/270; 220/266; 220/276; 215/253; 215/256

[58] Field of Search ..... 220/214, 265, 266, 270, 220/276, 306; 215/253, 254, 256

[56] References Cited

U.S. PATENT DOCUMENTS

| | | | |
|---|---|---|---|
| 750,257 | 1/1904 | Chapman . | |
| 1,849,768 | 3/1932 | Punte . | |
| 1,910,074 | 5/1933 | Wells . | |
| 2,254,559 | 9/1941 | Andresen . | |
| 2,751,102 | 6/1956 | Kihm . | |
| 3,120,900 | 2/1964 | Faulstich . | |
| 3,257,022 | 6/1956 | Robinson . | |
| 3,300,073 | 1/1967 | Benz | 215/256 |
| 3,388,827 | 6/1968 | Thanhauser et al. . | |
| 3,392,862 | 7/1968 | Faulstich . | |
| 3,407,957 | 10/1968 | Robinson . | |
| 3,420,397 | 1/1969 | Miller . | |
| 3,425,592 | 2/1969 | Vogel . | |
| 3,465,910 | 9/1969 | Richie . | |
| 3,514,299 | 6/1970 | Thanhauser . | |
| 3,516,572 | 6/1970 | Davis . | |
| 3,595,420 | 7/1971 | Miskin . | |
| 3,622,028 | 11/1971 | Lohrer . | |
| 3,653,529 | 4/1972 | Segmuller . | |
| 3,672,528 | 6/1972 | Faulstich . | |
| 3,673,761 | 11/1972 | Leitz . | |
| 3,746,199 | 7/1973 | Hart et al. . | |
| 3,753,511 | 8/1973 | Ruch . | |
| 3,773,207 | 11/1973 | Dokoupil et al. . | |
| 3,812,991 | 5/1974 | Wurl . | |
| 3,856,171 | 12/1974 | Rossi . | |
| 3,858,748 | 1/1975 | Marco . | |
| 3,900,129 | 8/1975 | Scholz . | |
| 4,006,839 | 2/1977 | Thiel et al. . | |
| 4,037,748 | 7/1977 | Stubbs, Jr. . | |
| 4,069,936 | 1/1978 | Ota . | |
| 4,090,660 | 5/1978 | Schram et al. . | |
| 4,103,803 | 8/1978 | Irvine . | |
| 4,113,136 | 9/1978 | Abbott . | |
| 4,209,101 | 6/1980 | Brown . | |
| 4,212,409 | 7/1980 | Jeppsson . | |
| 4,215,797 | 8/1980 | Chen . | |
| 4,252,248 | 2/1981 | Obrist et al. . | |
| 4,281,774 | 8/1981 | Mumford . | |
| 4,305,517 | 12/1981 | Dennis . | |
| 4,362,253 | 12/1982 | Wortley | 220/276 |
| 4,431,113 | 2/1984 | Sims, Jr. . | |
| 4,476,993 | 10/1984 | Krout . | |
| 4,487,329 | 11/1984 | Winstead . | |
| 4,493,432 | 1/1985 | Smith . | |
| 4,522,308 | 6/1985 | Sullivan | 215/256 |
| 4,546,892 | 10/1985 | Couput . | |
| 4,602,718 | 7/1986 | Duff | 215/253 |
| 4,679,699 | 7/1987 | Malsbury et al. . | |
| 4,718,571 | 4/1988 | Bordner . | |
| 4,721,210 | 1/1988 | Lawrence | 220/266 |
| 4,735,337 | 4/1980 | Von Holdt . | |
| 4,787,530 | 11/1988 | Edwards | 215/253 |
| 4,819,825 | 4/1989 | Landis | 220/270 |

*Primary Examiner*—George E. Lowrance

*Attorney, Agent, or Firm*—Watts, Hoffmann, Fisher & Heinke

[57] ABSTRACT

A package comprises a container having an open end defined by end structure forming a sealing portion and a rim surrounding the open end and a tamper evident lid closing the container end. The lid comprises seal structure in sealing engagement with the container sealing portion and a skirt disposed about the end structure and extending from the rim along the container in a direction away from the open end. The skirt defines a first skirt portion adjacent the rim and a second tear strip portion extending from the first skirt portion. The skirt portions are connected by a plurality of narrow necks extending between skirt perforations. Latching projections formed in the tear strip portion extend inwardly from the skirt in a direction toward the end opening. The projections latch with the container rim and engage the container rim for tearing the necks to strip off the tear strip when the lid is removed from the container.

19 Claims, 5 Drawing Sheets

TAMPER EVIDENT CONTAINER LID AND METHOD OF MAKING THE SAME

BACKGROUND OF THE INVENTION

1. Field Of The Invention

The present invention relates to tamper evident packages and more particularly to tamper evident packages having container lids constructed from thin, tearable materials which are readily applied to containers filled during packaging operations yet which are not removable from the containers without tearing and giving evidence of the container having been opened.

2. Prior Art

Tamper evident containers for food or perishable materials being sold at retail have been in regular usage. In most cases these types of containers were constructed for use with removable lids which positively sealed and locked the container closed during handling and shipment and while on sale at retail. These lids also permitted the container to be easily opened by the purchaser and sealingly reclosed to store partial contents.

The major consumers of tamper evident food containers and lids are food producers, such as commercial dairies, which in turn supply the grocery trade with prepackaged goods. These kinds of packages utilize packaging materials on a mass basis in high speed material handling equipment. Criteria by which these kinds of packagers select containers to be used for their goods include cost, ease of use in the existing packaging operations, performance of the package during product shipment, degree of evidence of tampering provided, ability of the purchaser to open and reclose the package after purchase, and appearance of the package.

Many prior art containers and lids have been complex, relatively expensive constructions employing lid locking structures and tear strips permitting removal of the lid locking structures only in a way which made such a removal evident to those viewing the container. These lids and containers were frequently formed from injection molded parts, or the equivalent, which had complicated molded-in locks and tear strips formed by lines of weakness molded into the lids.

These injection molded parts were expensive to use by packagers of food and perishable products. The containers and lids generally were designed to specially conform to each other. The capital expenses required by the container manufacturer for creating production tooling was relatively high. Moreover, container production speeds were limited because of the relatively slow molding processes. The total end-product price, using such packaging, thus tended to be relatively high.

Moreover, some packaging designs did not function well during shipment. In some designs the lids were equipped with projecting pull tabs or with flange-like shoulders. These were sometimes forced into engagement with adjacent packages when packed in shipping crates. Vibration or jostling during shipment in these circumstances sometimes caused partial removal or loosening of the lids. In other cases the lids were not removed or loosened but the tear strips were broken thus falsely indicating that the container had been opened. In either case the product was not salable.

Other designs were found to be difficult for purchasers to use because the initial removal of the lid from the container was physically difficult, or was too complicated to be adequately explained in printing on the lid itself, or because the lids did not adequately evidence the fact that the associated container had been opened.

Alternative proposals for package constructions involved manufacturing the containers and lids from "thermo-formed" plastics. These parts were produced by forming sheet plastic on molds while applying heat and pressure. Parts so constructed can be rapidly produced in great volumes and thus tend to be quite inexpensive. The nature of the thermo-forming process is such that the containers and lids produced by it have relatively uniform thin walls. Thus these parts were not readily formed into lid structures having tear strips with thick, rigid wedge-like teeth, or projecting locking fingers for locking against a container lip. Thermo-formed parts were better adapted to be used for sealing products in a way where "tampering" (or lid loosening) was not evidenced by the lid itself. As a consequence thermo-formed parts (or other parts constructed from thin sheets of material) were not widely used as tamper evident containers, with a few exceptions.

One proposal for using thermo-formed lids in a tamper evident application was to form a more or less standard lid, seal it onto a container of food or other product, and then apply a band of shrink-wrap plastic around the lid so that the lid could not be removed from the container without first tearing and removing the shrink wrap. In a variation on this theme, it has been proposed that the lid itself be formed from a shrinkable material which, after the lid is installed on the container, is shrunk about the container in such a way that the lid can not be removed from the container without first tearing and removing a tear strip portion of the lid.

These approaches had the disadvantage of requiring the packager to perform additional, sometimes expensive and time consuming, steps in the packaging process. For example, shrink bands had to be assembled to the packages after the lid was in place and the shrinking process itself was often conducted by heating the shrink bands. Thus, in addition to extra handling, the heating requirement resulted in a need for heating equipment in the packaging line and sometimes resulted in heating the packaged product itself which was usually undesirable.

SUMMARY OF THE INVENTION

The present invention provides a new and improved tamper evident container lid and method of making the same wherein the new lid is quickly and easily sealed in place on a container during the packaging process without requiring extraneous packaging steps and equipment (such as would be required for heat shrinking), and wherein the lid is of extremely simple construction yet provides positive package sealing and unmistakable evidence that its package has been tampered with or opened.

A tamper evident container lid constructed in accordance with a preferred form of the invention comprises a seal structure for establishing sealing engagement with a container and closing an end opening thereof, and a lid skirt extending about the outer periphery of the lid. The lid skirt comprises a first tear strip skirt portion and a second skirt portion disposed between the tear strip portion and the seal structure. The tear strip portion is defined by a series of skirt perforations and includes a plurality of latching projections disposed along the juncture of the tear strip portion and the second skirt portion. Narrow necks formed between adjacent skirt perforations frangibly connect the tear strip portion to the second skirt portion, with each projection having a neck at its base and each projection extending inwardly relative to the skirt proceeding in the direction of the second skirt portion from the tear strip portion.

A package constructed according to a preferred embodiment of the invention comprises a container having an open end defined by end structure forming a sealing portion and a rim surrounding the open end with the tamper evident lid closing the container end. The lid seal structure is sealingly engagable with the container sealing portion, and when the package is initially sealed closed, the latching projections extend into latching relationship with the container rim so that the projections engage the container rim and tear the necks to strip off the tear strip when the lid is removed from the container.

In the preferred and illustrated embodiment of the invention the latching projections are generally circularly curved tab-like structures having relatively broad bases and with at least one side of each base ending at one of the frangible necks. As the lid is initially pushed onto the container the projections resiliently deflect as they slide over the outer diameter of the outwardly flared container rim lip. The projections spring back to their undeflected positions after passing over the container rim so that when the lid is pulled from the container the projections are forced under the rim lip which then causes the adjacent neck to fracture and release a portion of the tear strip from the lid.

Another important feature of the invention resides in a method of making a tamper evident container lid comprising the steps of forming a container lid having a sealing structure extending about a central lid panel portion, fabricating a lid skirt extending about the outer lid periphery, the proximal skirt end formed continuously with the lid and the distal skirt end spaced away from the proximal end, perforating the skirt between its ends at circumferentially spaced locations to define latching projections extending in a direction away from the distal skirt end and inwardly toward the central panel portion, and connecting the latching projections to the skirt by narrow frangible necks of skirt material.

These and other features of the invention will become apparent from the following description of a preferred embodiment made with reference to the accompanying drawings which form part of the specification.

BEST MODE FOR CARRYING OUT THE INVENTION

Figure 2:
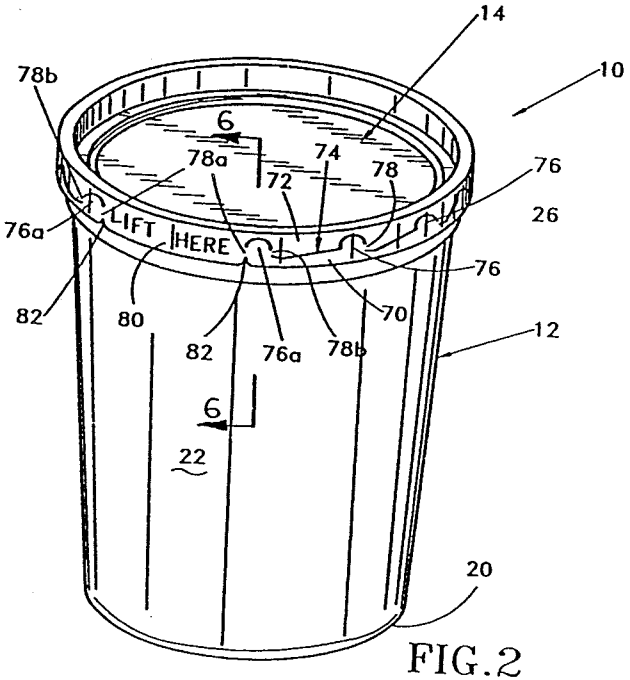
FIGS. 2–4 are perspective views of a package embodying the present invention viewed from different vantage points about the package.
Figure 1:
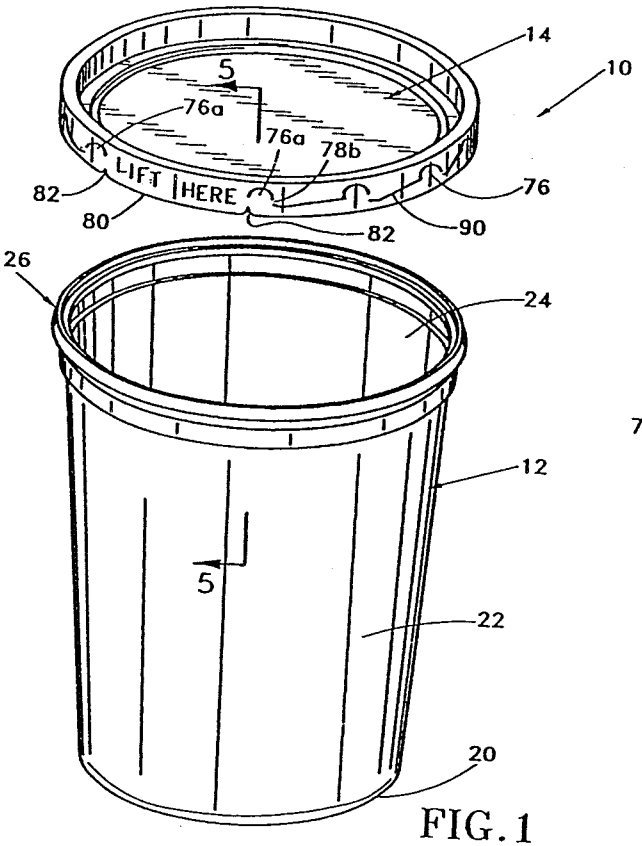
FIG. 1 is a perspective view of a container and tamper evident lid constructed according to the invention with the lid positioned for assembly to the container.
Figure 3:
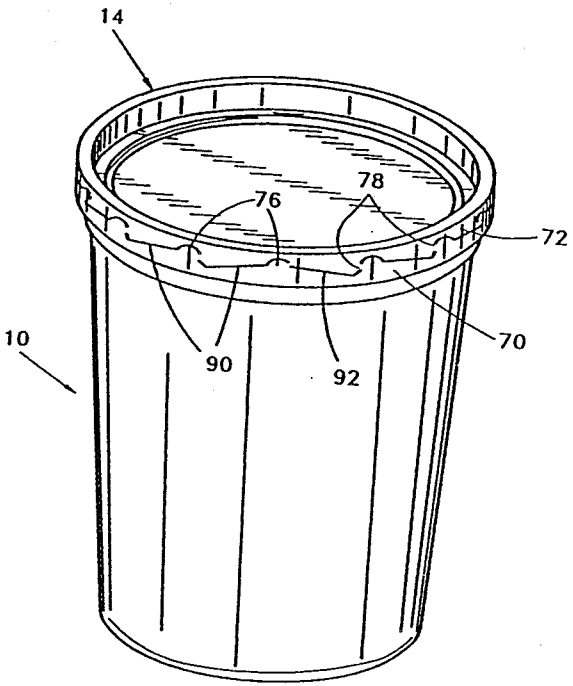

Referring now to the drawings, FIGS. 1–3 illustrate a package 10 of the sort used to contain and display perishable food products for sale at retail. The illustrated package 10 is one which is typically used for dairy products, like cottage cheese, and is formed from plastic materials. The package 10 is constructed so that it securely seals its contents during shipment and while on display for sale, yet is easily opened after purchase and resealed by the purchaser as often as required until none of the contents remain for consumption. The package 10 comprises a container 12 and a lid 14 which seals the container in such a way that until the package is initially opened the lid is latched in place on the container. When the lid is initially removed, or partially removed, a portion of the lid is broken away so that the fact of its removal is evident to an observer. Lids of this type are thus referred to as "tamper evident."

The container 12 is illustrated as being of generally conventional construction, formed from a thermoplastic material, and having a cup-like, or tub-like, configuration. The container comprises a circular base 20 closing one end of the container, an imperforate, slightly frusto-conical side wall 22 continuous with the base 20 and extending to an opposite, open end 24, and end structure 26 formed by the container adjacent the open end 24. The container 12 can be constructed from any suitable plastic material, for example, polystyrene, polypropylene or polyethylene and may take any appropriate configuration, so long as the container configuration is provided with an end structure compatible with tamper evident lids constructed according to the invention. The preferred container is manufactured by a thermo-forming process which is well known and therefore not described further here.

Figure 5:
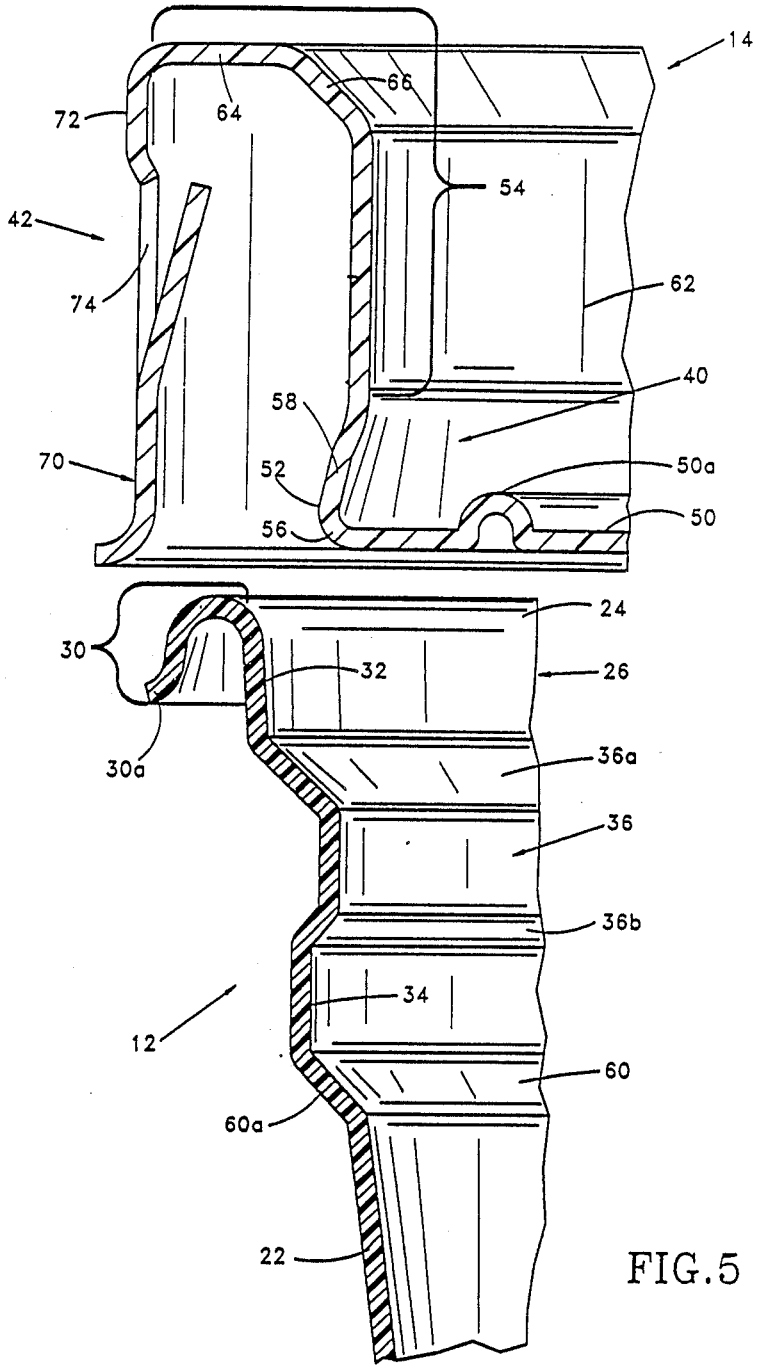
FIG. 5 is an enlarged fragmentary cross-sectional view seen approximately from the plane indicated by the line 5—5 of FIG. 1.
Figure 6:
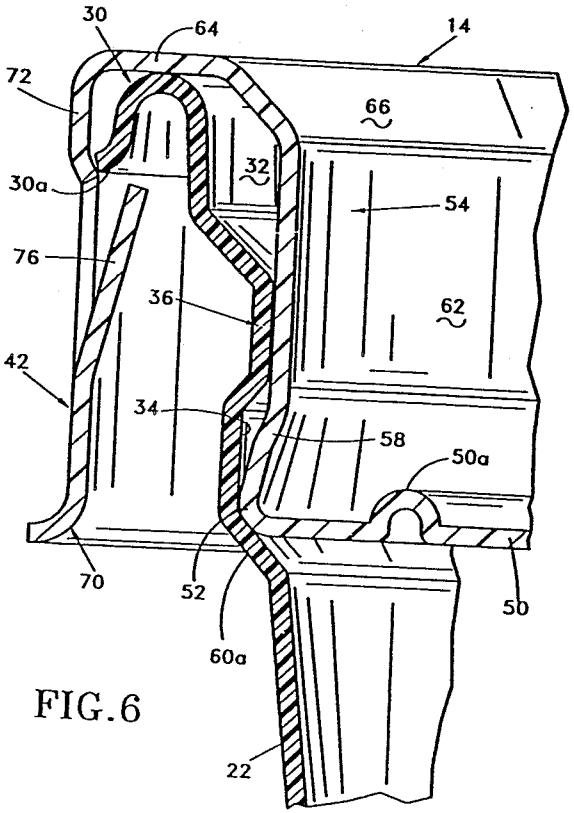
FIG. 6 is an enlarged fragmentary cross-sectional view seen approximately from the plane indicated by the line 6—6 of FIG. 2.
Figure 7:
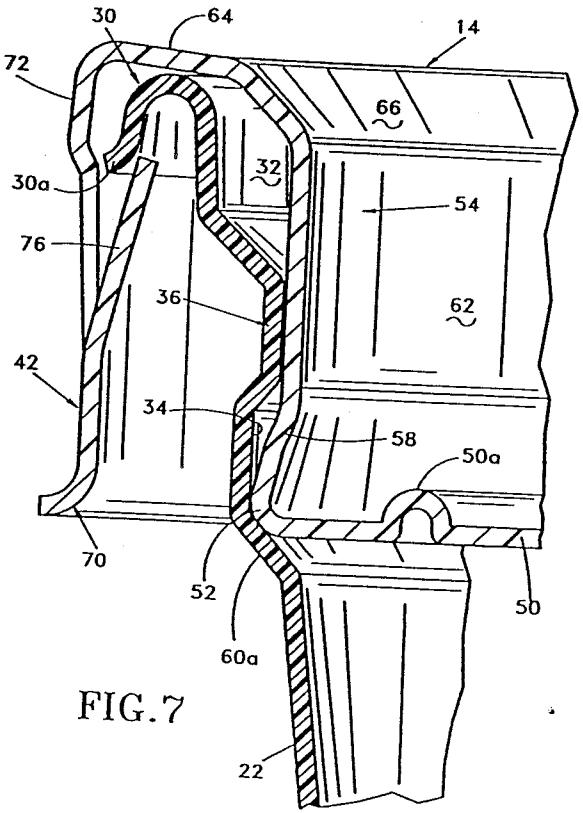
FIG. 7 is an enlarged fragmentary cross-sectional view seen approximately from the plane indicated by the line 7—7 of FIG. 4.

The illustrated container end structure 26 is so constructed and arranged that the tamper evident lid 14 is latched in place to it until the package is initially opened, after which the end structure enables the lid to open and reclose the container repeatedly to facilitate storing the contents over time. The end structure 26 as illustrated by FIGS. 5–7 of the drawings comprises a container rim 30 extending about the open end 24, a generally cylindrical rim wall 32 extending from the open end of the container and adjoining the rim, a cylindrical sealing groove 34 formed in the container wall for receiving and sealing against the lid, and a circumferentially extending detent section 36 (sometimes called a "barb" section) between the sealing groove and the rim wall for securing the lid in sealing relationship with the sealing groove.

A tamper evident lid 14 constructed according to the present invention is latched and sealed to the container during the packaging operation after the container has been filled so that the package can not be opened without tearing, or fracturing, the lid in a way which is apparent to observers. The illustrated and preferred lid 14 comprises a seal structure 40 for establishing sealing engagement with a container in the vicinity of its end opening to close the container, and a lid skirt 42, extending about the lid outer periphery, which is constructed and arranged to initially lock the lid on the container and to facilitate removal and resealing the lid to the container after the package is opened.

The seal structure 40 extends about a central lid panel portion 50 and comprises a peripherally extending seal bead 52 and a lid rim construction 54 supporting the bead in sealing engagement with the container between the panel portion 50 and the skirt 42. The lid panel portion 50 can be of any appropriate configuration but, as shown, is formed by a flat, circular panel having a stiffening rib 50*a* embossed near its outer periphery. The panel portion 50 closes the container end opening 24 and is usually formed with a central flat area suitable for printing labels or other indicia (not illustrated).

The sealing bead 52 is formed by the smooth juncture of an arcuate fillet wall 56 surrounding the panel portion 50 and a frusto-conical wall 58 which converges proceeding toward the lid rim 54. The sealing bead 52 extends continuously about the lid and resiliently engages the container sealing groove 34 when the container is closed.

The detent section 36 includes frusto-conical camming walls 36*a*, 36*b* which engage the seal bead 52 and guide the bead past the detent section as the lid is placed on and removed from the container. The camming wall 36*b* reacts against the sealing bead wall 58 to urge the bead into contact with the sealing groove 34 as well as to resiliently resist removal of the bead from the sealing groove 34. The end of the sealing groove opposite the detent section is joined to the container wall 22 by a converging wall section 60 which forms an external stacking support face 60*a* for facilitating nesting the containers during handling and shipping prior to their being filled with product.

The lid rim 54 is formed by a generally cylindrical rim wall 62 extending from the sealing bead to a lip section 64 overlying the container rim 30. The rim wall and lip section are connected by an imperforate frusto-conical transition wall 66.

The lid skirt 42 comprises a first tear strip skirt portion 70 and a second skirt portion 72 disposed between the tear strip portion and the seal structure 40. The skirt portion 72 is formed continuously with and is proximal, or near, the seal structure. The tear strip portion 70 is remote from the seal structure. The skirt is 42 is defined by a series of skirt perforations, generally designated by the reference character 74, and includes a plurality of latching projections 76 disposed along the juncture of the tear strip portion 70 and the second skirt portion 72. Narrow necks 78 of the skirt material frangibly connect the tear strip portion 70 to the second skirt portion 72.

Each latching projection 76 is a generally circularly curved tab-like structure which is relatively wide at its base as compared to its projecting height. The projections 76 are axially aligned with each other along the skirt 42 and each projection 76 has a neck 78 at its base. Each projection extends inwardly relative to the skirt 42 at an acute angle proceeding in the direction of the second skirt portion 72 from the tear strip portion 70.

As the lid is initially pushed onto the container, the inwardly inclined projections 76 resiliently deflect radially outwardly as they slide over the outer diameter of the outwardly flared container rim lip 30*a* (See FIGS. 5–7). The projections 76 spring back to their undeflected positions after passing over the rim lip 30*a* (FIG. 6) so that when the lid is pulled from the container the projections 76 are forced under the rim lip (see FIG. 7). The force of engager and between the rim lip 30*a* and the projection causes the adjacent neck 78 to fracture and release a portion of the tear strip 70 from the lid.

In the preferred embodiment of the invention the skirt portion 72 includes a pull tab 80 which extends between and separates the ends of the tear strip portion 70. The pull tab 80 is provided with a printed or embossed instruction to "lift" or "pull" the tab 80 in a direction away from the end of the container to open the package. The opposite ends of the pull tab 80 are each defined by a notch 82 in the skirt 42 and by a latching projection 76*a* having one end of its base aligned with the notch.

A neck 78*a* is formed between the notch 82 and the adjacent projection base end so that when the pull tab 80 is manually lifted relative to the container end the material at the end of the notches tears and each neck 78*a* is severed. This results in the projections 76*a* both being forced into engagement with the rim lip 30*a* and the necks 78*b* at the other ends of the projections 76*a* being severed. As the pull tab 80 continues to be lifted away from the container after the necks 78*a*, 78*b* have been severed, the projections 76, proceeding in both directions around the lid 14 from the pull tab, are successively forced against the container rim lip and sever their associated necks 78. This results in the tear strip portion of the skirt being stripped off and separated from the lid.

In the preferred embodiment of the invention the latching projections 76 beyond the projections 76*a* are formed by the skirt perforations 74 and adjacent latching projections have elongated generally linear slit-like skirt perforation segments 90 extending between them. Each segment 90 forms an end of the base of its associated latching projection and extends to a location near the base of the adjacent projection to form a neck 78. Because the latching projections 76 are axially aligned about the lid skirt 42 the perforation segments 90 are canted as they extend from the base of one projection to a location near the base of the adjacent projection.

It has been noted that if the segments 90 extend in a straight line form their projection to the adjacent neck 78, a relatively sharp point of skirt material remains on the skirt potion 72 after the neck is severed. If the segment ends adjacent the necks 78 are curved slightly in the direction of the neck, as illustrated by FIGS. 1–4 and 8, severing the necks 78 is accomplished without creating pointed fracture lines.

Figure 4:
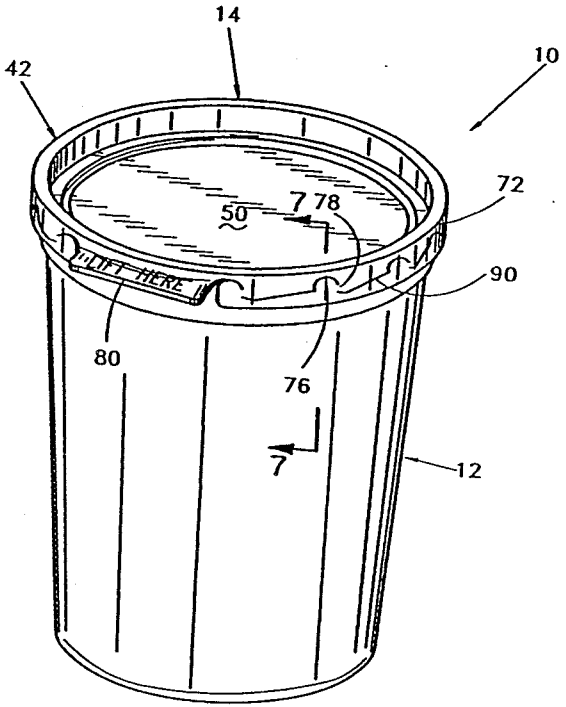
Figure 8:
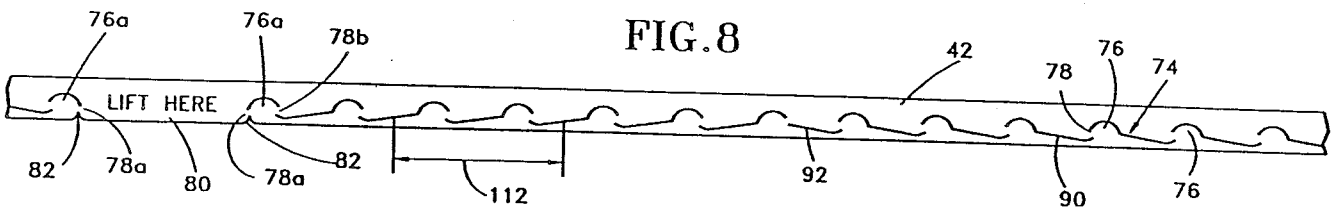
FIG. 8 is a developed view of a part of the lid illustrated in FIG. 1.

As illustrated by FIGS. 2,4 and 8 the latching projections 76*a* at the ends of the pull tab 80 have necks 78*b* defined by the ends of respective skirt perforation segments 90 which extend in opposite respective directions from the projections 76*a*. This is the preferred tear strip construction and thus it is necessary to provide a transition perforation segment 92 between adjacent latching projections at some point along the skirt periphery. In the illustrated lid 14 the transition segment 92 is disposed between adjacent latching projections diametrically opposite the pull tab 80 (see FIG. 3). It should be appreciated that other locations for the transition segment 92 could be provided if desired.

It has been found that the material from which the lid is fabricated should be one which exhibits strength and resilience yet can be torn or severed by exerting shearing forces on it. High impact polystyrene is a material which has been found to exhibit particularly suitable properties for use as a lid 14. Using high impact polystyrene plastic for the lid has also led to the observation that the number of latching projections used in a given lid is determined at least in part by the lid material. For example, in a lid having a tear strip length of around 13 inches, a total of 14 latching projections (including those at the pull tab ends) has been found to yield optimum lid performance. If more projections are formed in the lid (by shortening the length of the segments 90 for example) the lid itself tends to tear, probably because the aggregate strength of the necks being subjected to severing forces is excessive. On the other hand the use of too few latching projections (by lengthening the segments 90) reduces the structural integrity of the lid unacceptably.

The lid 14 is preferably thermo-formed, i.e. fabricated from a thin sheet of plastic which is subjected to heat and pressure while forced into engagement with forming molds, to produce its finished shape. After the lid is formed the skirt 42 is perforated by tooling designed to produce the tear strip portion 70, the latching projections 76, and the related skirt perforations.

Figure 10:
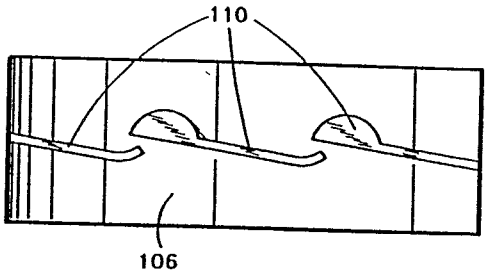
FIG. 10 is an elevational view of part of the equipment of FIG. 9 seen approximately from the plane indicated by the line 10—10 of FIG. 9.
Figure 11:
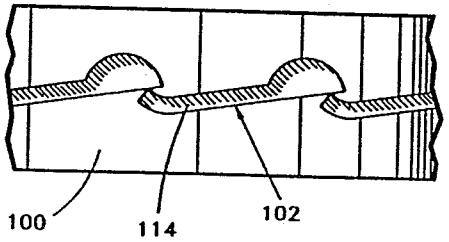
FIG. 11 is an elevational view of part of the equipment of FIG. 9 seen approximately from the plane indicated by the line 11—11 of FIG. 9.
Figure 9:
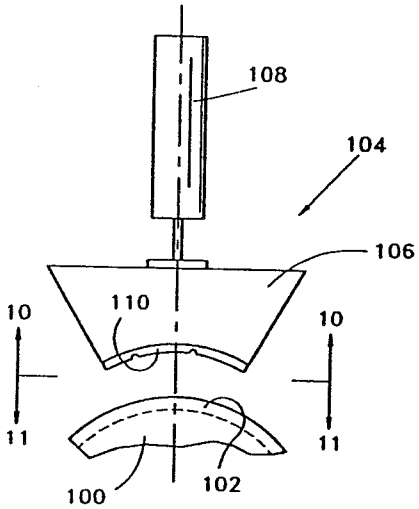
FIG. 9 is a fragmentary plan view of a portion of forming equipment for fabricating container lids according to the invention.

FIGS. 9–11 schematically illustrate tooling for producing this tamper evident skirt structure. The formed lid 14 is placed on an annular die 100 which is constructed to fit within the skirt 42 around the seal bead 52 and lid rim 54 so that the skirt 42 is rigidly supported by the die 100. The outer cylindrical face of the die 100 is formed with a peripherally extending die cavity 102 shaped to conform to the shape of the skirt perforations 74 and the notches 82 (see FIG. 11).

The die 100 is fixedly mounted on a fixture (not illustrated) which also supports an array of punches 104 which are disposed about and surround the die. Each punch (only one of which is shown) includes a punching tool 106 and an actuator 108 for driving the punching tool into a lid skirt supported on the die 100. Each punching tool carries a concave wedge-like blade formation 110 constructed to form a predetermined circumferential segment of the skirt perforations 74. For example, the illustrated punching tool 106 is constructed to form that part of the skirt perforations indicated by the reference character 112 in FIG. 8.

The punching tools 106 are preferably simultaneously actuated to form the skirt perforations 74 extending around the lid (as shown in FIG. 8) although they can be successively operated if desired. When the punching tools have been withdrawn the completed lid is removed from the die and replaced by the next succeeding lid and the punching operation is repeated.

When a punching tool 106 is actuated into the skirt 42 the blade 110 punches through the skirt wall into the die cavity 102. The die cavity is shaped to closely correspond to the blade formation so that the skirt material is sheared by the action of the blade moving into the cavity. In the preferred embodiment of the invention the cavity 102 is filled with a resilient rubber-like compound 114 which supports the skirt material pushed into the cavity 102 by the punching operation. The compound 114 resiliently springs back after the blade 110 is withdrawn from the die so that the displaced skirt material (namely the latching projections) is returned toward the skirt. This facilitates removal of the lid from the die 100 after the punching step.

The latching projections 76 remain in their inwardly inclined positions (see FIG. 5, for example) after removal of the lid from the die 100 at least partly because the sheared edges of the skirt material frictionally engage and maintain the projections so oriented.

It is contemplated that the punching operation can be accomplished in association with printing indicia and labels on the lids which is a common practice prior to shipping the lids and containers to packagers. It may also be possible to combine punching operation with the thermo-forming process so that the lid skirts are punched contemporaneously with the skirt molding operation. It should also be apparent that a latching container lid of the character described can be manufactured by completely different techniques if desired.

While only a single preferred embodiment of the invention has been illustrated and described herein in considerable detail, the present invention is not to be considered limited to the precise construction disclosed. Various adaptations, modifications and uses of the invention may be devised by those skilled in the art to which the invention relates and the intention is to cover hereby all such adaptations, modifications and uses falling within the scope or spirit of the appended claims.

Having described our invention we claim:

1. A package comprising:

(a) a container having an open end defined by end structure forming a sealing portion and a rim surrounding the open end; and (b) a tamper evident lid closing the container end, the lid comprising:

(i) seal structure in sealing engagement with the container sealing portion;

(ii) a skirt disposed about said end structure and extending from said rim along said container in a direction away from the open end, said skirt defining a first skirt portion adjacent said rim and a second tear strip portion extending from said first skirt portion, said skirt portions connected by a plurality of narrow necks extending between skirt perforations, and latching projections formed in said tear strip portion adjacent said first skirt portion, said projections extending inwardly from said skirt and projecting in a direction toward said end opening, said projections extending into latching relationship with said container rim with said projections engaging the container rim and tearing the necks to strip off the tear strip when the lid is removed from the container.

2. The package claimed in claim 1 wherein said lid is constructed from a plastic material.

3. The package claimed in claim 1 wherein said latching projections are formed by skirt perforations.

4. The package claimed in claim 1 wherein said latching projections each having a base which is relatively wide compared to its height and wherein one end of each base terminates in a neck portion.

5. The package claimed in claim 4 wherein said latching projections are generally arcuately curved tab-like structures.

6. The package claimed in claim 4 wherein said latching projections are formed by skirt perforation's and further including a skirt perforation segment extending from an end of the base of one latching projection to a location adjacent an end of an adjacent latching projection.

7. The package claimed in claim 1 wherein said first skirt portion defines a pull tab extending therefrom, said tear strip portion extending about said lid from opposite circumferential ends of said pull tab.

8. The package claimed in claim 1 wherein said container rim comprised an outwardly flared lip portion.

9. A tamper evident container lid comprising:

(a) a seal structure for establishing sealing engagement with a container in the vicinity of an end opening thereof to close the opening; and (b) a lid skirt extending about the outer periphery of the lid comprising:

(i) a first tear strip portion;

(ii) a second skirt portion disposed between the tear strip portion and the seal structure;

(iii) said tear strip portion defined by a series of skirt perforations and comprising a plurality of latching projections disposed along the juncture of the tear strip portion and the second skirt portion; and, (iv) a plurality of narrow necks formed between adjacent skirt perforations for frangibly connecting said tear strip portion to said second skirt portion, each projection having a neck at its base and projecting inwardly relative to said skirt proceeding in the direction of said second skirt portion from said tear strip portion.

10. The lid claimed in claim 9 wherein said lid skirt is constructed rom a thin sheet of tearable plastic material.

11. The package claimed in claim 9 wherein said latching projections are formed by skirt perforations.

12. The package claimed in claim 9 wherein said latching projections each having a base which is relatively wide compared to its height and wherein one end of each base terminates in a neck portion.

13. The package claimed in claim 12 wherein said latching projections are generally arcuately curved tablike structures.

14. The lid claimed in claim 9 wherein said tear strip skirt portion extends partially around the periphery of the lid and said second skirt portion comprises a pull tab portion projecting between ends of said tear strip portion.

15. The lid claimed in claim 14 wherein said lid is generally circular and said lid skirt is generally cylindrical.

16. The lid claimed in claim 14 wherein said pull tab is connected to said tear strip by a narrow neck of material disposed between a notch in said skirt and a skirt perforation.

17. A method of making a tamper evident container lid comprising the steps of:

(a) forming a container lid comprising sealing structure which extends about a central lid panel portion;

(b) fabricating a lid skirt extending about the outer periphery of the lid with the proximal skirt end formed continuously with the lid and the distal skirt end spaced away from the proximal end;

(c) perforating the lid skirt between its ends at circumferentially spaced locations to form a tear strip skirt portion connected to the skirt by narrow necks of skirt material between adjacent perforations; and, (d) configuring the perforations to define latching projections in the tear strip portion which extend in a direction away from the distal skirt end and inwardly toward the central lid panel portion.

18. The method claimed in claim 17 wherein forming a container lid and fabricating a skirt thermo-forming a plastic sheet.

19. The method claimed in claim 17 wherein perforating the lid skirt comprises punching the skirt material to form slit-like perforations.

* * * * *